US008443559B2

(12) United States Patent
Nugue

(10) Patent No.: US 8,443,559 B2
(45) Date of Patent: May 21, 2013

(54) DEVICE FOR FIXING SUBSTRATES, IN PARTICULAR GLASS SUBSTRATES

(75) Inventor: Jean-Clement Nugue, Lamorlaye (FR)

(73) Assignee: Saint-Gobain Glass France, Courbevoie (FR)

( * ) Notice: Subject to any disclaimer, the term of this patent is extended or adjusted under 35 U.S.C. 154(b) by 907 days.

(21) Appl. No.: 11/915,595

(22) PCT Filed: May 22, 2006

(86) PCT No.: PCT/FR2006/050466

§ 371 (c)(1),
(2), (4) Date: Jan. 10, 2008

(87) PCT Pub. No.: WO2007/000543

PCT Pub. Date: Jan. 4, 2007

(65) Prior Publication Data

US 2008/0190051 A1 Aug. 14, 2008

(30) Foreign Application Priority Data

May 27, 2005 (FR) ..... 05 51392

(51) Int. Cl.
*E06B 7/00* (2006.01)

(52) U.S. Cl.
USPC ..... 52/204.593; 52/204.62; 52/786.13

(58) Field of Classification Search
USPC ..... 52/204.57, 204.58, 204.593, 204.599, 52/204.62, 204.63, 204.65, 786.1, 786.13, 52/235
See application file for complete search history.

(56) References Cited

U.S. PATENT DOCUMENTS

| | | | | |
|---|---|---|---|---|
| 6,105,319 | A * | 8/2000 | Brunt | 52/204.593 |
| 6,430,894 | B1 * | 8/2002 | Chae et al. | 52/786.1 |
| 6,796,091 | B2 * | 9/2004 | Elmer | 52/235 |
| 6,941,721 | B2 * | 9/2005 | Lind | 52/786.13 |
| 7,497,639 | B2 * | 3/2009 | Lebot et al. | 403/277 |

FOREIGN PATENT DOCUMENTS

| | | | |
|---|---|---|---|
| DE | 296 22 665 | | 6/1997 |
| DE | 19647607 | * | 1/1998 |
| DE | 198 58 527 | | 8/2000 |
| EP | 0 698 717 | | 2/1996 |
| FR | 2 849 889 | | 7/2004 |
| WO | 03/006774 | | 1/2003 |

OTHER PUBLICATIONS

Machine translation of DE19647607.*

* cited by examiner

*Primary Examiner* — Jessica Laux
(74) *Attorney, Agent, or Firm* — Oblon, Spivak, McClelland, Maier & Neustadt, L.L.P.

(57) ABSTRACT

A fastening device for substrates, for example for glass substrates assembled as a multiple glazing unit, including retaining elements placed between at least one of the two substrates facing one another and a supporting structure for transferring loads of the substrates to the supporting structure. The retaining elements include a mechanism to compensate for dimensional variations. The compensation mechanism allows a relative movement between the substrates.

19 Claims, 2 Drawing Sheets

DEVICE FOR FIXING SUBSTRATES, IN PARTICULAR GLASS SUBSTRATES

BACKGROUND OF THE INVENTION

I. Field of the Invention

The present invention relates to a fastening device for plates, in particular for plates of glass substrate, comprising retaining elements placed between each substrate and a supporting structure for the purpose of transferring the loads of the substrates to the supporting structure, which retaining elements comprise means for limiting the dimensional variations or differences, the deformations and the movements between the substrates and the supporting structure.

II. Description of Related Art

During the production of glass facades for tertiary buildings or buildings for domestic purposes, many techniques are known that use isolated retaining or fastening elements that support the glazing units, for example in a facade revetment, only over a small surface area, that make it possible to produce largely transparent constructions.

Thus, there exist, for example, systems that support the substrates in pairs at their peripheral joint bead that separates them or at the retaining elements that pass through drill holes made in the substrates.

For the safety of glass facades, various loads are of importance. On the one hand, there are the external loads (weight of the glass itself, wind, precipitation, impacts, etc.), and, on the other hand, those that result from actions via stresses following, for example, temperature variations, tolerances in the supporting structure and assembly errors, for example.

In addition, it is known that a glass substrate is fragile and, unlike ductile materials (metals or plastics, for example), supports only elastic deformations and no plastic deformation.

In principle, the glass substrate must therefore be subjected to minimal mechanical strains during the transfer of loads exerted by the latter on the supporting structure.

Thus, when mechanically strong facades need to be designed, these facades being obtained by the juxtaposition of a plurality of glass substrates, the designer has several solutions:

- a first solution consists in overdimensioning the glass substrates, this overdimensioning usually being achieved in the thickness of the substrate. The main disadvantage of this solution lies in the fact that it leads to an increase in the weights, which assuredly involves an overdimensioning of the retaining elements and a reinforcement of the supporting structure.
- a second solution consists not in overdimensioning the glass substrates but in accepting between them and the supporting structure retaining elements that incorporate degrees of freedom (in translation, in rotation, combination of the two) making it possible to induce movements between the substrates and the supporting structure without placing the substrates under stress.

This second solution gives full satisfaction as long as it is appropriate to compensate for the dimensional tolerances between the substrates or to transmit forces originating from external loads (wind for example) to the supporting structure, but it does not work when it is necessary to withstand forces resulting from temperature variation of the gaseous fluid trapped between the two substrates. Specifically, any temperature variation in a direction of an increase or decrease in temperature induces variations in the volume or pressure of the trapped fluid and generates phenomena of swelling or, on the contrary, phenomena of contraction between the substrates that may cause stresses on the substrates that exceed the acceptable mechanical limits thereby risking causing breakages.

BRIEF SUMMARY OF THE INVENTION

The object of the present invention is therefore to alleviate these disadvantages by proposing enhancements to the retaining elements between the substrates and the supporting structure that limit the effects of variation of the thermodynamic state of the fluid trapped between the substrates.

Accordingly, the fastening device that is the subject of the invention, for substrates, in particular for substrates, particularly glass substrates, assembled in the form of a multiple glazing unit, comprising retaining elements placed between at least one of the two substrates facing one another and a supporting structure for the purpose of transferring the loads of the substrates to the supporting structure, which retaining elements comprise means of compensating for the dimensional variations, is characterized in that said compensation means also comprise sliding means allowing a relative movement between said substrates.

In preferred embodiments of the invention, it is also possible to have recourse to one and/or other of the following dispositions:

- the sliding means comprise, on the one hand, a first element interacting with a first substrate, and, on the other hand, a second element interacting with the means of compensating for the dimensional variations fixedly attached to a second substrate.
- the means of compensating for the dimensional variations comprise a two-part device with eccentric element.
- the second element comprises a sleeve with relative movement relative to the first element.
- the second element is fixedly attached to the means of compensating for the dimensional variations.
- the second element is fixedly attached to one of the parts of the device with eccentric element.
- the first element comprises, at one of its free ends, means of connection with an insert.
- the insert is designed to interact with one of the substrates, said insert being arranged to be received or to be formed in situ in a hole with curved-profile and retentive walls, said hole being made in one face of said substrate, said insert being made from at least one removable piece made in a deformable material.
- the first element comprises, at one of its free ends, a stop making it possible to limit in a controlled manner the movement of said first element relative to the second element.
- openings for the ingress and/or escape of air are provided in the installation tubular casing and/or in the eccentric rings.

According to another aspect of the invention, the latter aims at a construction assembly consisting of the juxtaposition of several substrates assembled with the aid of the previously described device.

BRIEF DESCRIPTION OF THE DRAWINGS

The invention will now be described in greater detail with the aid of nonlimiting examples and figures.

DETAILED DESCRIPTION OF THE INVENTION

Figure 1:
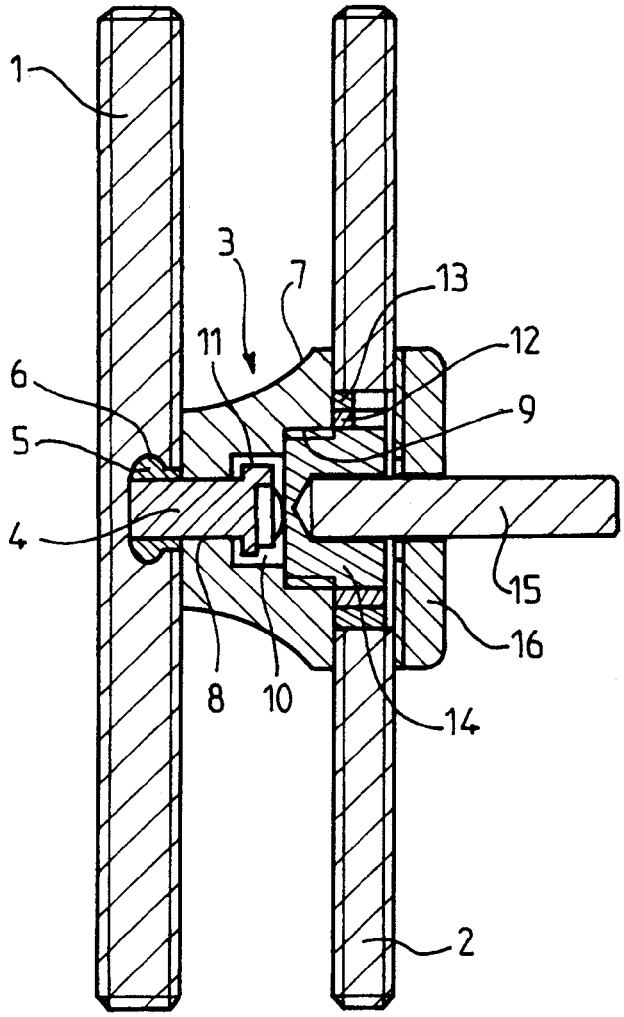
FIG. 1 is a view in section and in side elevation of the device that is the subject of the invention.
Figure 2:
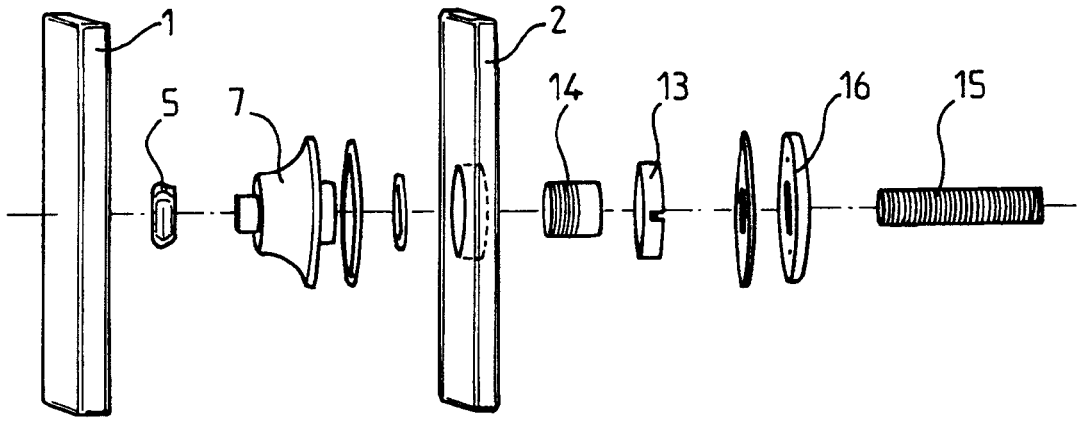
FIG. 2 is an exploded view of the device according to the invention.
Figure 3:
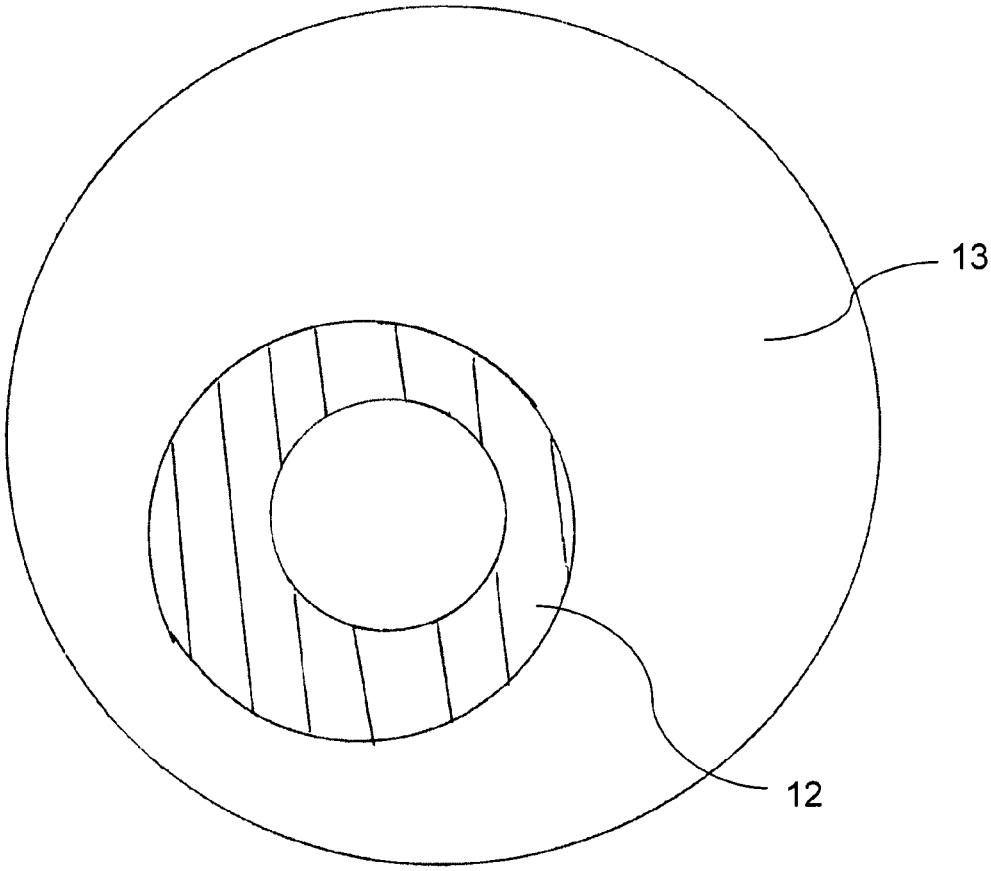

With reference first of all to FIG. 1, it can be seen that shown by reference numbers 1 and 2 are two substantially transparent substrates, made in particular of tempered glass, that are designed for example to form, when assembled together by known means that will not be explained in detail in this application, a substrate a multiple glazing unit (double glazing unit for example).

Such multiple glazing units, when they are juxtaposed, form transparent facades that are held on a supporting structure by a plurality of retaining elements marked 3 in FIG. 1.

As can also be seen in FIG. 1, the retaining element 3 is in fact formed by the assembly of a plurality of elements.

Thus, the retaining element 3 comprises a first element 4, obtained from a metal or plastic extrusion and with a cross section of varied profile, particularly circular, one of whose free ends is provided with a connection means with an insert 5, this connection means being able to be a thread, a bayonet assembly or any other equivalent system.

This insert 5, that will be described in greater detail hereinafter, is designed to be pushed into a blind hole 6, only one of which can be seen in FIG. 1. Naturally, depending on the intended applications, the holes may be open-ended, circular, oblong, etc.

Each of these holes 6 is delimited by a flat bottom, and by a side wall connected to the bottom via a region of curved and retentive profile, particularly concave, with the concavity turned toward the inside of the hole 6 and having an axial symmetry.

The depth of the holes 6, at the bottoms, corresponds, for example, at most to half the thickness of the plate 1.

Into each of the holes 6 is inserted an insert 5 made by molding in a plastic such as PVDF, for example (polyvinylidene fluoride), or in metal (aluminum for example). As a variant, this insert may be molded in situ. This insert is either a single piece or composed of several elements. It is elastically deformable, even plastically deformable so as to be able to be inserted into the hole.

The insert 5 comprises a plurality of regularly spaced and relatively deep radial notches, extending to the vicinity of the bottom, which may, where necessary, be pierced.

By these notches, the side wall of the insert 5 is thus divided into "petals", which give the insert a flexibility, the "petals" thus being able to flex inward to allow the insertion, by elastic, or even plastic deformation, of the insert 5 into a hole 6; once the insert 5 has been inserted, the petals return to their initial position, hugging the external surface of the hole. The coupling of the insert 5 beneath the aforementioned flange is achieved in this way.

The other free end of the first element 4 is designed to slide or slip freely inside a second element forming the retaining element 3.

In FIG. 1, this second element 7 is effectively formed by a piece made by molding or machining a plastic or metal and is generally in the shape of a truncated cone.

According to one feature of this second element 7, one of its characteristic dimensions (specifically its thickness) is less than the distance of the internal space of the double glazing unit.

This second element 7 comprises substantially two bores coaxial with its main axis in order to delimit a first orifice 8 in which the first element 4 may slide (that is to say allow a relative movement in translation), then in the extension of this first orifice 8, a second orifice 9 delimiting a cavity in which means of compensating for the dimensional variations can interact, whose function and structure will be detailed hereinafter.

According to a first variant embodiment, provision is made to place between the two orifices 8, 9 made in this second element, a third bore delimiting between the two end orifices a cavity 10 capable of receiving a protruding part 11 made in the form of a shoulder at the other free end of the first element 4, this protruding part making it possible to insert a translational stop into the kinematic arrangement connecting the first element 4 to the second element 7.

According to a second variant embodiment, the translational stop between the first element 4 and the second element 7 is made by a pin that radially traverses both the first element 4 and the second element 7, the axial gap or clearance being obtained by the respective dimensions of the orifices made (in fact one of the orifices, for example that which is made in the first element 4, is circular, while that which is made radially in the second element is oblong so as to allow a movement of the pin connecting the two pieces).

The means of compensating for the dimensional variations will be described in detail.

This is a device with eccentric element formed by the assembly of an inner ring 12 and an outer ring 13, made of plastic or metal, obtained by a series of machining operations achieved by cropping.

The eccentric rings have a circular external diameter and an off-center hole, the external diameter of the smaller eccentric ring 12 (the inner ring) of the pair corresponding to the diameter of the off-center hole made in the larger eccentric ring 13 (the outer ring). The off-center holes of the small eccentric rings may be brought into precise alignment relative to one another by a simple rotation of the eccentric rings of the pair.

The two rings are force-fitted into an open-ended hole made in one of the substrates substantially opposite the blind hole made in the substrate receiving the insert 5.

The overall disposition in the hole of the substrate then forms a bearing cushion for the insertion of the fastening element 15 in the form of a stem, for example a bolt to be screwed that will have to connect with the supporting structure.

The fastening element 15 in the form of a stem may be housed therein directly or even indirectly by using an installation tubular casing 14 extending between the outer surfaces of the substrate 2.

In the example shown in FIG. 1, the tubular casing 14 that is connected to one of the rings (the inner ring 12) is provided with a connection means (a thread for example) making it possible to assemble it and fixedly attach it to the second element 7 forming the sliding means on the first element 4.

The length of the preferably cylindrical installation tubular casing 14 is adapted to the thickness of the substrate 2, so that it does not pass beyond an outer face of the pane after it has been installed in a bearing and sealing cushion 16. Depending on the possibilities, the end faces of the installation tubular casing should be level with the faces of the substrates.

According to an advantageous feature of the invention, it is necessary to insert between the space situated between the substrates and the environment an orifice allowing an escape of the fluid one of whose variables of thermodynamic state has changed. Openings for the ingress and/or escape of air are provided in the installation tubular casing and/or in the eccentric rings.

One of the advantages of the invention lies in the fact that if one of the substrates constituting the facade should break, particularly closest to the supporting structure, it generates no dangerous instability of the other components relative to said structure.

The invention claimed is:

1. A fastening device for first and second substrates of a multiple glazing unit, the device comprising:

a retaining element placed between at least one of the first and second substrates facing one another and a supporting structure, the retaining element being configured to transfer loads of the first and second substrates to the supporting structure, wherein the retaining element includes:

a sliding element that allows a relative movement between the first and second substrates, the sliding element including a first element, fixedly attached to the first substrate, and a second element, and a compensating element that compensates for dimensional variations, the compensating element including a two-part device with eccentric element including two rings, the two rings including a first inner ring disposed within a second outer ring, one of the rings being fixedly attached to the second substrate and the other one of the rings being fixedly attached to the second element of the sliding element, wherein the first and second elements of the sliding element are freely slidable one relative to the other in a direction perpendicular to the substrates in an assembled state of the retaining element attached between the first and second substrates.

2. The fastening device as claimed in claim 1, wherein the second element includes a sleeve that allows movement of the second element relative to the first element.

3. The fastening device as claimed in claim 1, wherein the first element includes, at one free end thereof, a connection with an insert.

4. The fastening device as claimed in claim 3, wherein the insert interacts with the first substrate, the insert further configured to be received or to be formed in situ in a hole with curved-profile and retentive walls, the hole being made in one face of the first substrate, the insert being made from at least one removable piece made of a deformable material.

5. The fastening device as claimed in claim 4, wherein the hole is symmetrical about an axis collinear with a thickness of the first substrate.

6. The fastening device as claimed in claim 4, wherein a depth of the hole is substantially half of a thickness of the first substrate.

7. The fastening device as claimed in claim 4, wherein a longitudinal axis corresponding to a depth of the hole is collinear with an axis of the compensating element.

8. The fastening device as claimed in claim 1, wherein the first element includes, at one free end thereof, a stop configured to limit in a controlled manner movement of the first element relative to the second element.

9. The fastening device as claimed in claim 1, further comprising openings for ingress and/or escape of air in an installation tubular casing and/or in rings of the two-part device with eccentric element.

10. The fastening device as claimed in claim 1, wherein the two substrates are glass substrates assembled as a multiple glazing unit.

11. A construction assembly comprising a juxtaposition of a plurality of substrates assembled with the device as claimed in claim 1.

12. The fastening device as claimed in claim 1, wherein the two rings of the two-part device with eccentric element are disposed within a thickness of the second substrate.

13. The fastening device as claimed in claim 1, wherein the two rings of the two-part device with eccentric element are disposed entirely within a thickness of the second substrate.

14. The fastening device as claimed in claim 1, wherein the first element protrudes from only one face of the first substrate.

15. The fastening device as claimed in claim 1, wherein the second element has a funnel shape.

16. The fastening device as claimed in claim 1, wherein an axial length of the second element of the sliding element is less than a distance of an internal space between the first and second substrates.

17. A glazing unit, comprising:

first and second substrates spaced a distance apart and facing each other;

a retaining element placed between at least one of the first and second substrates and a supporting structure, the retaining element being configured to transfer loads of the first and second substrates to the supporting structure, wherein the retaining element includes:

a sliding element that allows a relative movement between the first and second substrates, the sliding element including a first element, fixedly attached to the first substrate, and a second element, and a compensating element that compensates for dimensional variations, the compensating element including a two-part device with eccentric element including two rings, the two rings including a first inner ring disposed within a second outer ring, one of the rings being fixedly attached to the second substrate and the other one of the rings being fixedly attached to the second element of the sliding element, wherein the first and second elements of the sliding element are freely slidable one relative to the other in a direction perpendicular to the substrates in an assembled state of the retaining element attached between the first and second substrates.

18. A fastening device for first and second substrates of a multiple glazing unit, the device comprising:

a retaining element placed between at least one of the first and second substrates facing one another and a supporting structure, the retaining element being configured to transfer loads of the first and second substrates to the supporting structure, wherein the retaining element includes:

means for sliding that allows a relative movement between the first and second substrates, the sliding means including a first element, fixedly attached to the first substrate, and a second element, and means for compensating for dimensional variations, the compensating means including a two-part device with eccentric element including two rings, the two rings including a first inner ring disposed within a second outer ring, one of the rings being fixedly attached to the second substrate and the other one of the rings being fixedly attached to the second element of the sliding means, wherein the first and second elements of the sliding means are freely slidable one relative to the other in a direction perpendicular to the substrates in an assembled state of the retaining element attached between the first and second substrates.

19. The fastening device as claimed in claim 18, wherein the first element includes, at one free end thereof, means for connecting with an insert.

* * * * *